United States Patent [19]

Hauner

[11] 4,345,542

[45] Aug. 24, 1982

[54] APPARATUS FOR PARAFFINING YARN

[75] Inventor: Friedrich Hauner, Ingolstadt, Fed. Rep. of Germany

[73] Assignee: Schubert & Salzer, Ingolstadt, Fed. Rep. of Germany

[21] Appl. No.: 186,495

[22] Filed: Sep. 12, 1980

[30] Foreign Application Priority Data

Sep. 29, 1979 [DE] Fed. Rep. of Germany ... 7927734[U]

[51] Int. Cl.[3] ..... B05C 1/06

[52] U.S. Cl. ..... 118/78; 57/295

[58] Field of Search ..... 118/78; 57/295, 296; 427/11

[56] References Cited

U.S. PATENT DOCUMENTS 3,306,253 2/1967 Frentzel-Beyme ..... 118/78 X

OTHER PUBLICATIONS

Laughner, V. H. et al., Handbook of Fastening and Joining of Metal Parts, New York, McGraw-Hill Book Co., Inc., 1956, p. 508.

*Primary Examiner*—Evan K. Lawrence

[57] ABSTRACT

For paraffining yarn or thread with paraffin wax, a thread guide rail (3, 4) is provided before and after a rotationally mounted paraffin body (2) in the direction of travel of the thread. The paraffin body (2) is displaceable in the direction of the plane defined by thread guide rails (3, 4) and its end position can be located by a stop which bears against the end of the paraffin body (2). The stop (5) is carried by one of the thread guide rails (3, 4) which is pivotable transversely to the travel of the thread from a working position in which it can be locked by a holding device (7). In the working position the paraffin body (2) bears against the stop (5). In order to change the paraffin body, the guide rail carrying the stop (5) is pivoted so that the traveling thread is moved out of the path of the paraffin body, thereby allowing the body to be removed without interfering with the travel of the thread.

4 Claims, 2 Drawing Figures

APPARATUS FOR PARAFFINING YARN

BACKGROUND OF THE INVENTION

The present invention relates to an apparatus for paraffining yarn or thread with paraffin wax. The apparatus includes a thread guide rail before and after a rotationally mounted paraffin body, in the direction of travel of the thread. The paraffin body as it is exhausted is displaceable in the direction of a plane defined by the thread guide rails and the end position of the paraffin body determined by a stop against which an end of teh paraffin body bears.

Such an apparatus is known through the DE-AS 2.105.558. When the paraffin body has to be replaced, production has to be interrupted and the stop loosened so as to be able to release the unused portion of the paraffin body.

SUMMARY OF THE INVENTION

It is the object of the present invention to make such an apparatus so that the paraffin body can be replaced without interruption of production.

According to the invention, this problem is solved in that one of the thread guide rails carries a stop and is pivotable, transversely to the travel of the thread, out of a working position in which it can be locked by a holding device and in which position the paraffin body bears against the stop, into a position wherein the paraffin body is released for removal. As a result of the locking, both the movable thread guide rail and the stop are securely held in their working position. In the position of rest, the paraffin body is released by the stop, while the thread is deflected somewhat, but can still be produced, withdrawn and wound up without disturbance. The exchange of the paraffin body for a new one takes so little time that the length of yarn which is not paraffined is of no importance. During the further processing on knitting and hosiery machines, the paraffin components deposited on the thread guides in time cause a subsequent paraffining of the thread, so that the thread can be processed satisfactorily.

The stop may advantageously be secured to the thread guide rail disposed in front of the paraffin body in the course of the thread. In this manner, a smaller thread guide rail and a smaller pivotal radius and pivotal travel suffice to bring the thread out of the region in front of the paraffin body, because this thread guide rail is considerably closer to the apex of the thread displacement triangle formed by the traverse of the thread.

The holding device may advantageously be constructed in the form of a resilient detent device. This renders possible a particularly rapid release of the thread guide rail from the working position or locking of the thread guide rail in the working position.

In order to prevent the thread, which is conveyed further, from coming into the region of the pivot pin and jamming there when the thread guide rail is in the position of rest, the pivotable thread guide rail may appropriately comprise a thread stop which restricts the movement of the thread in the direction of the pivot pin and which, in the preferred embodiment of the subject of the invention, is constructed in the form of a hook facing away from the pivot pin.

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1 shows a paraffining device constructed according to the invention in the front view; and FIG. 2 is a plan view showing the paraffining device according to the invention, with the omission of various parts.

DESCRIPTION OF A PREFERRED EMBODIMENT

Figure 1:
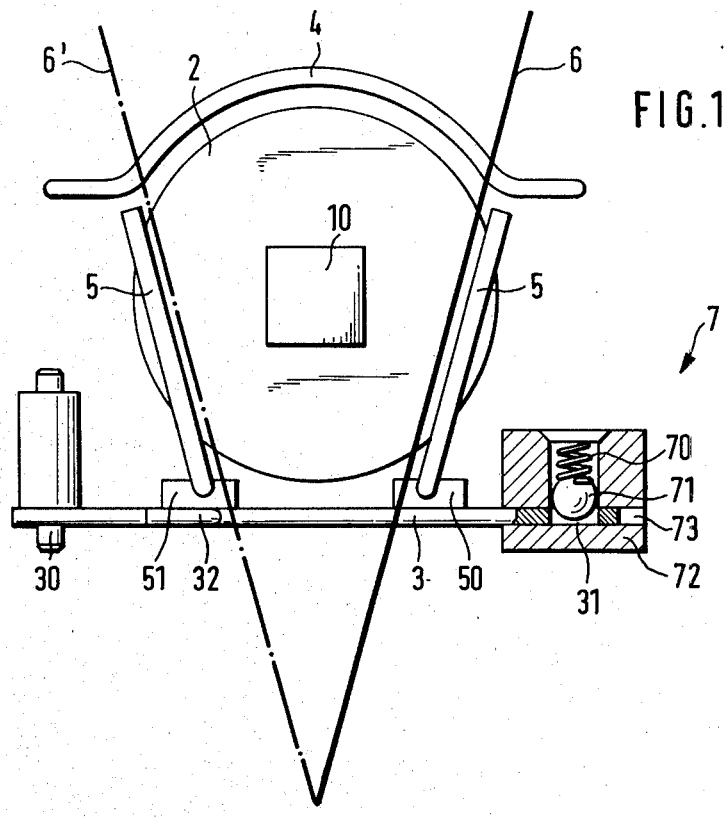
Figure 2:
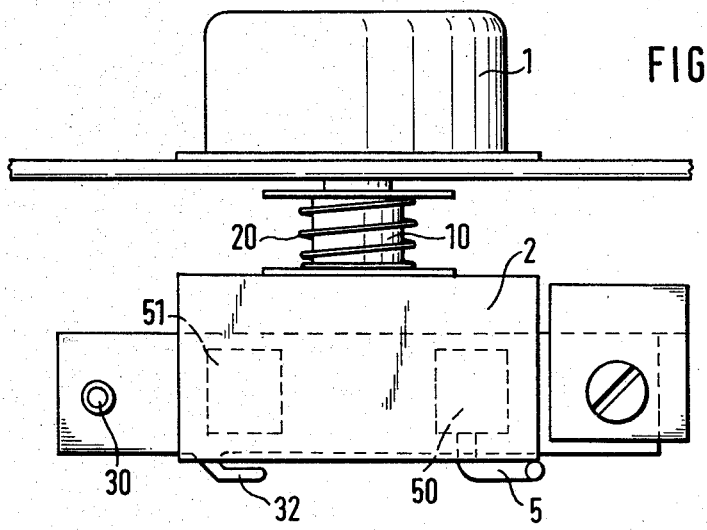

A paraffining device, disposed in front of a thread winding device, not shown, in the path of a thread, comprises a rotatable guide pin 10 which can be set in rotation, by a suitable drive device 1, for example a motor or a gear driven in a suitable manner, and on which a paraffin body 2 is placed. Provided in front of and behind the paraffin body 2 in the direction of travel of the thread are thread guide rails 3 and 4, by which a plane is defined towards which the paraffin body 2 is displaceable by means of a compression spring 20. The end position of the paraffin body 2 is determined by a stop 5 so that the paraffin body 2 penetrates through this plane and causes a slight deflection of the thread 6 bearing against the end of the paraffin body 2, out of this plane.

The stop 5 is secured to the thread guide rail 3 disposed in front of the paraffin body 2 in the path of the thread, by means of two holding blocks 50 and 51. The thread guide rail 3 is mounted, at one side, outside the range of the paraffin body, on a stationary pivot pin 30 and comprises, at its free end, a bore 31 in which a holding device 7 engages. According to the embodiment shown in FIG. 1, the holding device 7 is constructed in the form of a ball 71, which is loaded by a compression spring 70 and which penetrates partially into the bore 31 of the thread guide rail 3. The holding device 7 is carried by a stationary block 72 which comprises a slit 73 extending along the pivotal plane of the thread guide rail 3 and in which the thread guide rail 3 is supported in its working position.

The thread being produced passes the paraffining device on its way to a winding device with the thread 6 bearing against the thread guide rail 3 and against the thread guide rail 4. Between these two thread guide rails 3 and 4, the thread 6 bears against the end of the rotating paraffin body 2, and it is continuously moved out of the position 6 shown in full line into the position 6' shown in broken lines and back by a traversing device associated with the winding device. Since the paraffin body 2 is always urged forwards by the compression spring 20 and the position of the paraffin body 2 is determined by the stop 5, a constant paraffining of the thread 6 is assured regardless of the size of the paraffin body 2.

The paraffin body 2 is used up in time and must then be exchanged for a new one. By means of the apparatus according to the invention, this is possible without interrupting the production and winding processes. The operator merely needs to grasp the thread guide rail 3, with production in progress, and to pivot it about the pivot pin 30. The holding force of the resilient holding device 7 is overcome by using a slight pull. When the thread guide rail 3 is swung out, the thread 6 bearing against the thread guide rail 3 is deflected and the paraffin body 2 is released from the stop 5, so that it is urged forwards by the compression spring 20 and can easily be removed from the guide pin 10. The new paraffin body 2 is now placed on the guide pin 10, urged backwards and, as a result of swinging the thread guide rail 3 back into the working position, is secured in its operating position by the stop 5. The ball 71, which engages again, of the holding device 7, locks the thread guide rail 3 in its working position.

During the changing of the paraffin body 2, no paraffin is applied to the thread 6. The exchange of the used paraffin body 2 for a new one takes place so quickly, however, that the few meters of unparaffined yarn are insignificant. Paraffined yarn is used primarily in knitting and hosiery where the thread 6 is guided by a thread guide before reaching the loop-forming parts, a film of paraffin is deposited in the course of time and, in the event of nonparaffined sections of yarn, insures an adequate sliding and after-paraffining of the thread 6.

The holding device 7 may be constructed as desired, for example in the form of a detent hook which, on swinging to of the thread guide rail 3, engages behind the working edge and has to be urged away out of the pivotal path of this thread guide rail for the swinging away of the thread guide rail 3. Instead of a ball 71 which is acted upon resiliently, a pin may be provided which is mounted in the block 72 and is introduced into the bore 31 of the thread guide rail 3. A resilient detent device for this purpose has proved particularly advantageous, however, because separate manual intervention is not necessary to actuate such a holding device.

The thread guide rail 4 can be constructed according to the circumstances of the machine construction. The embodiment illustrated, in which this thread guide rail 4 follows the contours of the paraffin body 2, is only to be regarded as one possible example of an embodiment.

The stop 5 present outside the path of the thread may also vary in construction. In the embodiment shown, the stop 5 comprises two stop rails which are disposed at each side symmetrically with the path of the thread. By this means, tilting and hence an uneven paraffining of the thread 6 is avoided, particularly with paraffin bodies which have already become very small as a result of consumption. Since certain fluctuations are compensated for during the further processing of the thread 6, however, a stop 5 which is only disposed at one side of the path of the thread may be perfectly adequate.

In principle it does not matter for the present invention whether the stop 5 is disposed on the thread guide rail 3 in front of the paraffin body 2 in the direction of travel of the thread or on the thread guide rail 4 behind the paraffin body 2 in the direction of travel of the thread. Since the thread guide rail 4 is further away from the apex of the thread displacement triangle formed by the traversing of the thread 6, however, a longer deflection path is needed for the thread 6 in order to be able to exchange the paraffin body 2, without the thread 6 being a hindrance. A longer thread guide rail 4 with a greater distance of its working edge from the pivot pin and a larger pivotal angle would be necessary. For this reason, it is particularly appropriate if the stop 5 is carried by the thread guide rail 3 disposed in front of the paraffin body in the direction of travel of the thread.

During the pivoting of the thread guide rail 3 into its position of rest, it may happen, under some circumstances, that the thread 6 slides too far in the direction of the pivot pin 30 and jams there. In order to prevent this, in a further development of the paraffining device according to the invention, a thread stop 32, which limits the movement of the thread in the direction of the pivot pin 30, is provided at the working edge of the thread guide rail 3. In principle, a nose would suffice for this purpose. In order to eliminate the possibility of the thread 6 jumping over the thread stop 32 on fluctuations in the thread tension which may occur as a result of pivoting the thread guide rail 3 too suddenly, the thread stop 32 is constructed, in the preferred embodiment, in the form of a hook facing away from the pivot pin 30.

While a preferred embodiment of the invention has been described using specific terms, such description is for illustrative purposes only, and it is to be understood that changes and variations may be made without departing from the spirit or scope of the following claims.

What is claimed is:

1. An apparatus for paraffining yarn with paraffin wax supplied by a rotationally mounted paraffin body as said thread travels along a path, a thread guide rail positioned before and after said paraffin body in the direction of travel of said thread, said paraffin body being displaceable in the direction perpendicular to a plane extending through said guide rails, and a stop against which said paraffin body bears limiting the displacement of said paraffin body, comprising:

said guide rails (3, 4) supporting the thread on their side opposite the paraffin body;

means (30) for pivotally supporting at least one of said guide rails (3) for pivotal movement transversely relative to the path of travel of said yarn from a first position in which the yarn travelling along said path occupies a position further away from said body in front of said paraffin body to a second position thereby entraining said yarn to occupy a position outside the axial movement path of said paraffin body when being withdrawn from its working position;

means for supporting said stop on said one of said guide rails (3);

releasable lock means (7) for holding said one of said guide rails (3) in said first position wherein said stop bears against said paraffin body and for releasing said one of said guide rails (3) allowing said one of said guide rails to be pivoted to said second position wherein said stop (5) releases said paraffin body and said yarn being moved out of the path of said paraffin body thereby allowing said paraffin body to be removed without interferring with the travel of said thread.

2. The apparatus as set forth in claim 1 further comprising:

said releasable lock means constructed in the form of a resilient detent device.

3. The apparatus as set forth in claim 1 further comprising:

a thread stop (32) carried on said one of said guide rails on its side remote from the paraffin body between the area of said guide rail on which bears the thread when travelling along its path in the locked first position of said guide rail and said means (30) for pivotally supporting said one of said guide rails, said thread stop (32) limiting the movement of said thread in the direction of said means (30) for pivotally supporting at least one of said guide rails (3) when said guide rail (3) is moved to said second position.

4. The apparatus as set forth in claim 3 further comprising:

said thread stop (32) being constructed in the form of a hook facing away from said means (30) for pivotally supporting at least one of said guide rails (3).

* * * * *